US007004719B2

(12) United States Patent
Baldassarre et al.

(10) Patent No.: US 7,004,719 B2
(45) Date of Patent: Feb. 28, 2006

(54) AXIAL THRUST BALANCING SYSTEM FOR A CENTRIFUGAL COMPRESSOR, HAVING IMPROVED SAFETY CHARACTERISTICS

(75) Inventors: Leonardo Baldassarre, Florence (IT); Davide Betti, Borgo a Buggiano (IT); Leonardo Fusi, Montespertoli (IT)

(73) Assignee: Nuovo Pigone Holding S.p.A., Florence (IT)

( * ) Notice: Subject to any disclaimer, the term of this patent is extended or adjusted under 35 U.S.C. 154(b) by 166 days.

(21) Appl. No.: 10/691,554

(22) Filed: Oct. 24, 2003

(65) Prior Publication Data

US 2004/0086376 A1 May 6, 2004

(30) Foreign Application Priority Data

Nov. 5, 2002 (IT) ..... MI2002A2337

(51) Int. Cl.
*F04D 17/12* (2006.01)

(52) U.S. Cl. ..... 415/105; 415/107; 415/111; 415/230

(58) Field of Classification Search ..... 415/105, 415/107, 111, 112, 230
See application file for complete search history.

(56) References Cited

U.S. PATENT DOCUMENTS 5,412,977 A * 5/1995 Schmohl et al. ..... 415/105

FOREIGN PATENT DOCUMENTS

FR 2592688 A * 7/1987
JP 08296584 A * 11/1996

* cited by examiner

*Primary Examiner*—Edward K. Look
*Assistant Examiner*—Igor Kershteyn
(74) *Attorney, Agent, or Firm*—Nixon & Vanderhye P.C.

(57) ABSTRACT

An axial thrust balancing system for a centrifugal compressor, having improved safety characteristics, the centrifugal compressor comprising a rotor having impellers adjacent to each other and connected by a shaft, the rotor rotating in a stator, the centrifugal compressor additionally including a balancing piston, a balancing line being provided between an intake of a first compression stage and an area downstream of the balancing piston; this system comprises an intake mechanical gas seal around the shaft upstream of the first compression stage and an outlet mechanical gas seal downstream of the balancing piston, the balancing line being closable by blocking elements.

10 Claims, 1 Drawing Sheet

AXIAL THRUST BALANCING SYSTEM FOR A CENTRIFUGAL COMPRESSOR, HAVING IMPROVED SAFETY CHARACTERISTICS

BACKGROUND OF THE INVENTION

The present invention relates to an axial thrust balancing system for a centrifugal compressor, having improved safety characteristics.

In general terms, a centrifugal compressor is a machine which imparts to a compressible fluid a pressure greater than the intake pressure and which transfers the energy required for this pressure increase to the fluid itself, by means of one or more impellers or rotors arranged in series, having radial blades and driven at high speed by a motor connected to the compressor shaft by means of a coupling.

Typically, centrifugal compressors are used for a great variety of applications where high flow rates are required at medium to low pressures, for example in refrigeration systems, in the petrochemical industry, for example ethylene and catalytic cracking plants, and $CO_2$ compression units in urea plants, in the power industry, in liquid propane gas and oxygen plants, for instance, and in units for pressurizing gas pipelines and returning them to operation. The installed power is generally high.

In a centrifugal compressor, a pressure differential is generated in the axial direction between the various stages, and it is therefore necessary to fit a system of seals between the rotor and stator of each stage on the compressor rotor shaft, thus minimizing the phenomenon of backflow of the compressed fluid to the preceding stages, in order to maintain a suitable level of compression efficiency.

The increase of pressure in the downstream direction causes radial and axial forces to be generated in the rotor body owing to the presence of inevitable temporal irregularities of the whole system, and these forces must be balanced both statically and dynamically.

One of the characteristics that is most commonly required in rotors of centrifugal compressors, and of any rotating machines operating at high speed and with fluids at high pressure, is dimensional stability, even in the presence of operating fluctuations due to the temporal irregularities of the upstream or downstream flow or of the density or pressure of the actual gas being compressed.

Owing to the pressure increases imparted to the fluid progressively by the various component stages of the compressor, considerable axial forces are generated and act on the shaft of the machine. The resultant of these forces is usually so great that it cannot be balanced with a simple axial thrust bearing (regardless of the type).

In order to limit these axial forces, it is common practice to fit a balancing drum downstream of the final stage. Since the area downstream of the drum is connected via the balancing line to the machine intake, the drum is subjected to a pressure differential approximately equal to that developed by the whole machine. The corresponding force acting on the drum is therefore directed from the delivery towards the intake (for the sake of simplicity, we refer here to a machine with in-line stages) and therefore opposes the forces acting on the individual impellers.

By specifying a suitable drum diameter, the unbalanced thrust (which must be balanced by the axial bearing) can be reduced to the desired value. Normally, the value of this residual force is specified in such a way that the load is always applied in the same direction in all operating conditions, so that inversion of the load and consequent axial displacement of the rotor never occurs in any conditions.

The pressure differential acting on the two faces of the drum also causes a migration of gas from the side at higher pressure to the side at lower pressure.

In order to minimize this flow, it is common practice to fit a seal, the form of which may vary according to the type of application, at the position of the drum.

When this is done, the ends of the compressor will be at a common pressure, equal to the intake pressure of the machine.

Seals are normally fitted to block the flow of gas from the ends of the compressor to the external environment which is usually at atmospheric pressure.

Until recent times, these seals were of the oil type in the great majority of cases.

Over the last ten years there has been a considerable development of mechanical gas seals, such that current standards specify the use of this type of seal, except in certain rare cases.

It is known that the sealing efficiency of mechanical gas seals is very high and that leakage is very low.

The knowledge that the sealing efficiency of a gas seal is considerably greater than that of a conventional labyrinth or honeycomb seal has given rise to the idea of eliminating the leakage path formed by the balancing line of the compensating drum and thus relying solely on the end seal to provide the necessary sealing.

This solution has therefore been adopted in the art and the gas seal on the delivery end of a compressor has accordingly been given the additional function of balancing the axial thrust.

However, the elimination of the compensating drum gives rise to a number of difficulties.

The most significant aspects are those relating to safety: if there is a rupture in the gas sealing system, there will no longer be any element balancing the axial thrust, and this will have serious consequences for the compressor.

BRIEF SUMMARY OF THE INVENTION

The object of the present invention is therefore to overcome the aforementioned difficulties, particularly that of providing an axial thrust balancing system for a centrifugal compressor, having improved safety characteristics.

Another object of the present invention is to provide an axial thrust balancing system for a centrifugal compressor, having improved safety characteristics, which has the flexibility to meet the requirements of the various applications of the centrifugal compressor, in order to optimize efficiency at all times.

A further object of the present invention is to provide an axial thrust balancing system for a centrifugal compressor, having improved safety characteristics, which is particularly reliable, simple and functional, and relatively inexpensive.

A final object is to provide a fully reversible system, in other words one which makes it possible, by means of simple modifications, to return rapidly to the conventional compressor configuration (in which the delivery end gas seal is not used to balance the thrust). To express this concept in another way, this characteristic of flexibility must enable the present solution to be applied easily to machines already produced in the conventional configuration, in order to improve their performance.

BRIEF DESCRIPTION OF THE DRAWINGS

The characteristics and advantages of an axial thrust balancing system for a centrifugal compressor, having improved safety characteristics, according to the present invention are made clearer and more evident by the following description, provided by way of example and without restrictive intent, with reference to the attached schematic drawing, in which.

DETAILED DESCRIPTION OF A PREFERRED EMBODIMENT

Figure 1:
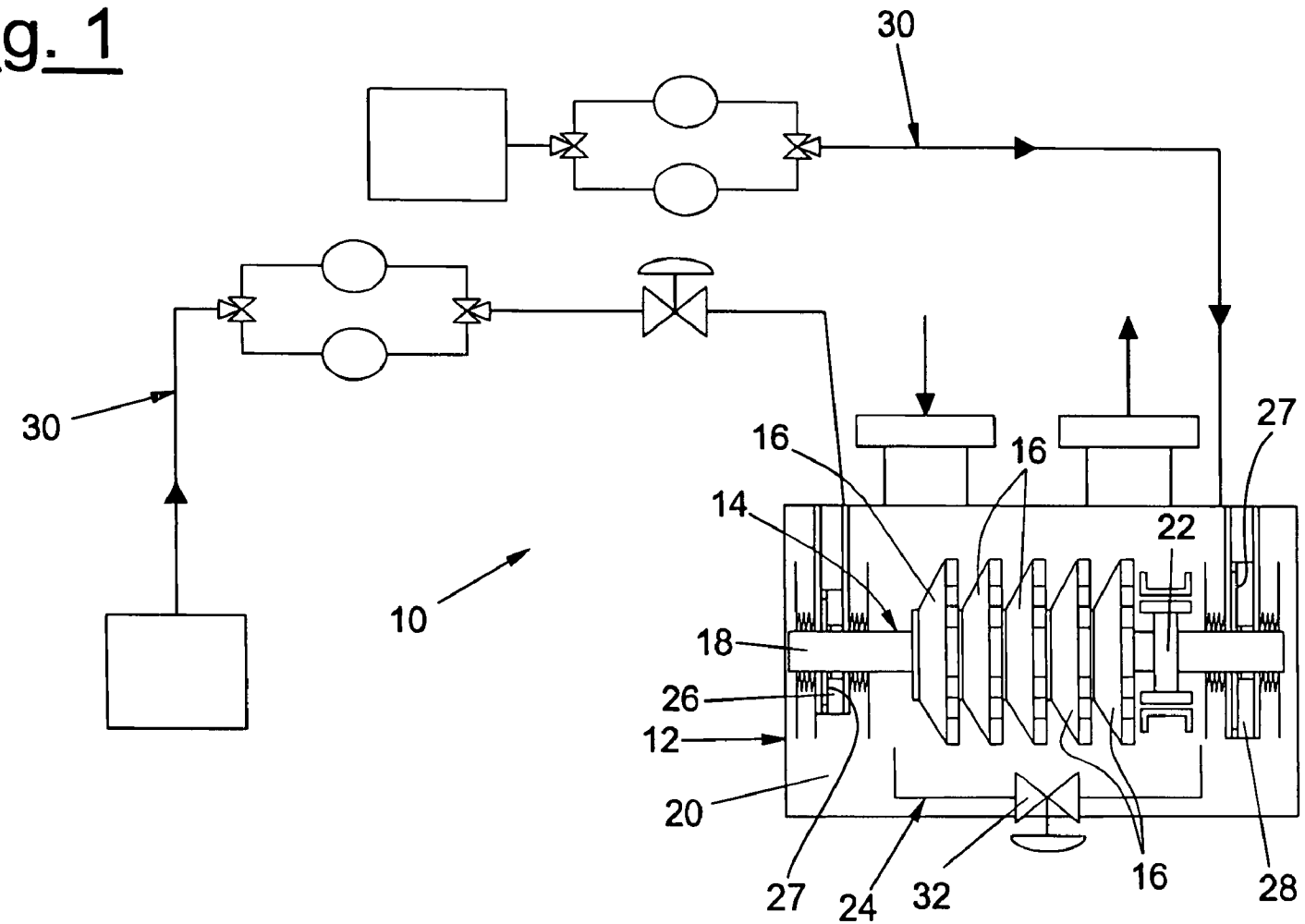
FIG. 1 is a diagram of an axial thrust balancing system for a centrifugal compressor, having improved safety characteristics according to the present invention.

With reference to FIG. 1, this shows an axial thrust balancing system, having improved safety characteristics and indicated as a whole by 10, for a centrifugal compressor 12.

The centrifugal compressor 12 comprises a rotor 14, in other words a rotating component, having impellers 16 adjacent to each other and connected by a shaft 18, which rotates in a stator 20, in other words a fixed component.

The centrifugal compressor 12 also includes a balancing piston or compensating drum 22 according to the prior art.

More precisely, the balancing piston 22 is keyed on the shaft 18 of the compressor 12, downstream of the final compression stage. A balancing line 24, to ensure the correct operation of the said balancing piston 22, is provided between an intake of the first compression stage and an area downstream of the balancing piston 22, according to the known art.

An intake mechanical gas seal 26 is provided around the shaft 18 upstream of the first compression stage; an outlet mechanical gas seal 28 is provided downstream of the balancing piston 22.

The two mechanical gas seals 26 and 28 are refilled with gas through a supply line 30.

In the embodiment according to the present invention, the axial thrust balancing system 10 includes the balancing piston 22, with its balancing line 24, and also the mechanical gas seals 26 and 28, with their supply line 30. More precisely, the balancing line 24 can be shut off by means of blocking elements 32, such as a shut-off valve.

The operation of the axial thrust balancing system 10 for a centrifugal compressor 12 according to the invention is clear from the above description provided with reference to FIG. 1, and can be summarized as follows.

The blocking elements 32 are operated to shut off the balancing line 24 of the compensating drum 22. This makes the mechanical seals 26 and 28 solely responsible for the sealing function.

In particular, the outlet mechanical gas seal 28, located at the delivery end of the compressor 12, has the additional function of balancing the axial thrust.

The diameter of the delivery end gas seal must therefore be made larger than that of the intake end seal, to enable the resulting axial thrust to be balanced.

If this is done, at least the following advantages will be obtained:

The possibility of returning easily to the balancing configuration provided by the balancing piston 22, by bringing the balancing line 24 back into operation and replacing the outlet gas seal 28 with one having a diameter equal to that of the intake seal 26, which is at the intake pressure of the centrifugal compressor 12.

The assurance of greater safety if there is a rupture in the system of mechanical gas seals 26 and 28; this is because the presence of the compensating drum 22 and its seal (even if made with greater clearance in order to prevent overheating), although it may not make any contribution in normal operating conditions (leakage to the exterior is practically zero), will cause a pressure differential to be created between the two sides of the said compensating drum 22 if the primary rings 27 of the gas seal 26 or 28 is ruptured, since the leakage will increase considerably. Thus the compensating drum 22 will return to its normal function of balancing the aerodynamic thrust generated by the impellers 16 (even if this is partial because of the increased clearance of the seal). It should be noted that, owing to the presence of the compensating drum 22, it is necessary to use at the delivery end a gas seal 28 having a diameter markedly greater than that which it would have had if the compensating drum 22 had been removed.

The possibility of implementing the solution according to the present invention even in existing machines: clearly, the fact that the architecture of the machine does not change when moving from one configuration to the other (the gas seal 28 and the compensating drum 22 are present at the delivery end in both cases) makes it possible to implement this solution in existing machines in such a way as to improve the thermodynamic performance.

During starting with the centrifugal compressor 12 pressurized, the difference in diameter between the two gas seals 26 and 28 causes the generation of an axial thrust equal to the product of the relative internal pressure of the compressor 12 and the difference between the area of the delivery gas seal 28 and that of the intake gas seal 26 at the intake end. Clearly the starting thrust becomes greater as the difference between the diameters of the two gas seals 26 and 28 increases.

The axial thrust causes the appearance of a frictional torque on the thrust bearing of the shaft 18 (in the case of lubricated bearings): this torque increases with the axial thrust.

To enable the centrifugal compressor 12 to be started, it may be necessary to use a direct-lubrication thrust bearing of what is known as the "jack in oil" type.

Another aspect of considerable importance for the correct operation of the axial thrust balancing system 10 for a centrifugal compressor 12 according to the present invention relates to the supply system for the gas seals 26 and 28.

This is because, as is known, a mechanical gas seal requires, for correct operation, a supply system which refills the said seal with clean fresh gas, in order to remove the heat generated between the rings of the seal.

In the present application, the gas seal 28 clearly operates with a pressure on the primary ring equal to the delivery pressure of the compressor 12.

In applications of the compressor 12 such as those requiring high pressure (reinjection, for example), where the use of the axial thrust balancing system 10 for a centrifugal compressor 12 according to the invention is particularly advantageous because of the considerable leakage at the balancing drum 22, the delivery end gas seal 28 requires a supply of gas at high pressure. Such gas is not always easily available in an industrial plant.

In a preferred embodiment of the axial thrust balancing system 10 for a centrifugal compressor 12 according to the present invention, the supply line 30 takes the gas from the delivery end of the diffuser of the final compression stage of the centrifugal compressor 12 (immediately upstream of the scroll) and sends it, through pipes external to the compressor 12 itself, to a high pressure filter; it then returns it to the interior of the compressor 12 at the positions of the end labyrinth seals of the compressor 12 (at the primary rings of the gas seals 26 and 28).

In practice, the supply line 30 is enabled to operate correctly because of the following circumstances.

In the first place, the gas is taken off at the delivery end of the diffuser (before entering the scroll), and therefore its pressure is greater than that of the delivery flange of the compressor 12.

Furthermore, the pressure at the primary ring of the gas seal 28 at the delivery end is less than the delivery pressure of the final impeller 16 because of the secondary effect present on the rear of the said final impeller 16.

Because of the tangential velocity component of the gas in the space between the rotor and stator at the rear of the final impeller 16 (the pressure gradient depends on the density of the gas and the square of the tangential velocity), a pressure differential is created between the delivery end of the final impeller 16 and the balancing drum 22.

If we disregard the pressure drop across the seal of the compensating drum 22, which has an increased clearance, the aforesaid pressure differential is also the pressure differential between the primary ring of the gas seal 28 and the delivery end of the impeller 16 of the final stage.

In high pressure applications (above 300 bar) this pressure differential is of the order of 5 to 6 bar.

Any uncertainties in the calculation of the pressures and consequently in the specification of the diameters of the mechanical gas seals 26 and 28 can be compensated for subsequently by appropriate pressurization of the primary ring of the gas seal 28 at the delivery end or that of the seal 26 at the intake end.

In laboratory tests, the axial thrust balancing system 10 for a centrifugal compressor 12 according to the present invention was applied successfully to a centrifugal compressor 12 with a low flow coefficient of an old type, whose performance was unsatisfactory. Before this solution was introduced, the recycling to the balancing line 24 was as much as 35% of the flange flow rate; after the introduction of the described modification, the aforesaid leakage could be eliminated almost completely (giving flow rates of the order of 400–500 sL/min.) and the required compression power could therefore be reduced to approximately 35%.

It should be noted that the leakage of gas across the balancing drum can be minimized by shutting off the balancing line. This ultimately makes it possible to increase the efficiency of centrifugal compressors.

It should be mentioned at this point that the axial thrust balancing system for a centrifugal compressor according to the present invention provides a fully reversible solution; in other words, it is possible to change from operation with a balancing piston to operation with mechanical gas seals.

The axial thrust balancing system for a centrifugal compressor according to the present invention can advantageously be used for maintaining and upgrading existing centrifugal compressors having balancing pistons of the conventional type, since the risks associated with a solution using mechanical gas seals alone are minimized by making it possible to return to a conventional solution with a balancing piston, simply by replacing a few components.

The above description has demonstrated the characteristics of the axial thrust balancing system for a centrifugal compressor, having improved safety characteristics according to the present invention, and has demonstrated the corresponding advantages.

Finally, it is clear that the axial thrust balancing system for a centrifugal compressor, having improved safety characteristics designed in this way can be modified and varied in numerous ways without departing from the invention; furthermore, all the components can be replaced with technically equivalent elements. In practice, the materials used, as well as the forms and dimensions, can be chosen at will, subject to technical requirements.

The scope of protection of the invention is therefore delimited by the attached claims.

What is claimed is:

1. Axial thrust balancing system for a centrifugal compressor, having improved safety characteristics, said centrifugal compressor comprising a rotor having impellers adjacent to each other and connected by a shaft, said rotor rotating in a stator, said centrifugal compressor including a balancing piston, a balancing line being provided between an intake of a first compression stage and an area downstream of the balancing piston, characterized in that said system comprises an intake mechanical gas seal around said shaft upstream of said first compression stage and an outlet mechanical gas seal downstream of said balancing piston, said balancing line being closable by means of blocking elements.

2. A balancing system according to claim 1, wherein said mechanical gas seals are refilled with gas from a supply line.

3. A balancing system according to claim 1, wherein said blocking elements comprise a shut-off valve.

4. A balancing system according to claim 1, wherein said outlet mechanical gas seal is located at a delivery end of said compressor and has a function of balancing said axial thrust.

5. A balancing system according to claim 1, wherein said outlet gas seal operates with a pressure on a primary ring equal to the delivery pressure of said compressor.

6. A balancing system according to claim 1, wherein, in high-pressure applications of said centrifugal compressor, said outlet mechanical gas seal is refilled with a supply of gas at high pressure.

7. A balancing system according to claim 6, wherein said supply line takes the gas from the delivery end of a diffuser of the final compression stage of said centrifugal compressor and, through pipes external to said centrifugal compressor, sends it to a high-pressure filter.

8. A balancing system according to claim 7, wherein said gas, taken from said delivery end of said diffuser of said centrifugal compressor, is returned into said centrifugal compressor at the positions of end labyrinth seals of said centrifugal compressor, at the positions of primary rings of said mechanical gas seals.

9. A balancing system according to claim 1, wherein uncertainties in the calculation of the pressures and in specification of the diameters of said mechanical gas seals can be compensated for by appropriate pressurization of primary ring of said outlet mechanical gas seal and/or that of said intake mechanical gas seal.

10. A balancing system according to claim 1, wherein said balancing piston is keyed on said shaft of said centrifugal compressor, downstream of the final compression stage.

* * * * *